United States Patent [19]

Caron et al.

[11] Patent Number: 4,606,306

[45] **Date of Patent: * Aug. 19, 1986**

[54] GLOW PLUG CONTROL CIRCUIT

[75] Inventors: LaVerne A. Caron, Naperville; Edward F. Handley, Clarendon Hills, both of Ill.

[73] Assignee: Navistar International Corporation, Chicago, Ill.

[ * ] Notice: The portion of the term of this patent subsequent to Jul. 23, 2002 has been disclaimed.

[21] Appl. No.: 738,146

[22] Filed: May 24, 1985

Related U.S. Application Data

[63] Continuation-in-part of Ser. No. 570,064, Jan. 12, 1984, Pat. No. 4,530,321.

[51] Int. Cl.[4] ..... F02P 19/02

[52] U.S. Cl. ..... 123/179 H; 123/145 A; 219/499

[58] Field of Search ..... 123/179 H, 179 B, 179 BG, 123/145 A; 219/499, 497, 515

[56] References Cited

U.S. PATENT DOCUMENTS

| | | | |
|---|---|---|---|
| 3,803,385 | 4/1974 | Sandorf | 219/499 |
| 3,866,587 | 2/1975 | Knapp | 219/499 |
| 3,955,067 | 5/1976 | Eldridge | 219/499 |
| 4,196,712 | 4/1980 | Kawamura et al. | 123/179 BG |
| 4,280,452 | 7/1981 | Kawamura et al. | 123/179 BG |
| 4,307,689 | 12/1981 | Raeske et al. | 123/145 A |
| 4,331,109 | 5/1982 | Arnault | 123/145 A |
| 4,375,205 | 3/1983 | Green | 123/179 H |
| 4,377,138 | 3/1983 | Mitani et al. | 123/179 H |
| 4,391,237 | 7/1983 | Abe et al. | 123/179 H |
| 4,399,781 | 8/1983 | Tsukasaki | 123/179 H |
| 4,413,174 | 11/1983 | Ting | 219/511 |
| 4,483,284 | 11/1984 | Andreasson | 123/145 A |
| 4,530,321 | 7/1985 | Caron et al. | 123/179 H |

FOREIGN PATENT DOCUMENTS

| | | | |
|---|---|---|---|
| 54-5137 | 1/1979 | Japan | 123/179 H |
| 57-159961 | 10/1982 | Japan | 123/145 A |
| 57-193779 | 11/1982 | Japan | 123/145 A |

*Primary Examiner*—Andrew M. Dolinar

*Attorney, Agent, or Firm*—F. David Aubuchon; Dennis K. Sullivan

[57] ABSTRACT

The glow plug control circuit (28) is coupled to one or more glow plugs (31,38) and includes a resistance bridge, the resistance (30) of the parallel connection of the glow plugs plus the resistance (76) of lead wire conductors being coupled to the bridge which has a first resistance leg, a second resistance leg, a third resistance leg (53), and a fourth resistance leg (54). A junction (128,130) between two resistance legs (56,53) is coupled to a source of voltage potential and a junction (67) between the other two resistance legs (53,54) is coupled to ground (67). A comparator (72) has plus and minus inputs (70,74) and an output (82). One junction (58) between two of the resistance legs (53,54) is coupled to the minus output (74). One of the other resistance legs coupled between the voltage source and ground includes two series connected resistors (51,52) which define a voltage divider (41) and which are coupled to the glow plugs. The junction (60) between the resistors (51,52) is connected to the plus input (70). An RC circuit (resistor 332 and capacitor 146) coupled to the output of the comparator (72) prevents the generation of false reset signals. Further a timed wait light reset circuit (340) ensures turning off of the wait light irrespective of a reset signal.

8 Claims, 9 Drawing Figures

GLOW PLUG CONTROL CIRCUIT

CROSS REFERENCE TO RELATED APPLICATION

This Application is a Continuation-In-Part of U.S. Application Ser. No. 570,064 filed on Jan. 12, 1984 and entitled: GLOW PLUG CONTROL CIRCUIT and now issued to U.S. Pat. No. 4,530,321.

BACKGROUND OF THE INVENTION

1. Field of the Invention

The present invention relates to glow plug control circuits. More specifically, the present invention relates to a glow plug control circuit which provides for the rapid heating of a bank of parallel connected glow plugs to their set temperatures without overheating and for a subsequent temperature controlled intermittent "afterglow" energization of the glow plugs for an ambient-temperature-related time period.

2. Description of the Prior Art

Heretofore, various glow plug control circuits have been proposed for rapidly heating one or more "rapid warmup" glow plugs under controlled conditions to prevent overheating and damage to the glow plugs. One of the first such circuits was developed by the Automotive Products Division of Allied Chemical Corporation and is described in SAE Technical Paper No. 709208 by Arthur R. Sundeen, published Feb. 26, 1979. Such circuit utilizes a bimetal control element which allows for a rapid heating of the glow plugs to a set temperature followed by intermittent heating which can be represented by an undulating waveform as the bimetal element opens and closes electrical circuits as it heats and cools in an "afterglow" delayed energization period.

The controller utilized in the Allied Chemical Corporation control circuit utilizes a timer in which time is based on the characteristics of the bimetal element which serves as a "surrogate" for the glow plugs.

Examples of various glow plug control systems that use resistance bridges, comparators, control circuits and/or timer circuits are disclosed in the following patents:

| U.S. Pat. No. | PATENTEE |
|---|---|
| 3,803,385 | Sandorf |
| 3,866,587 | Knapp |
| 3,955,067 | Eldridge |
| 4,164,261 | Igashira et al. |
| 4,196,712 | Kawamura et al. |
| 4,280,452 | Kawamura et al. |
| 4,375,205 | Green |
| 4,377,138 | Mitani et al |
| 4,391,237 | Abe et al. |
| 4,399,781 | Tsukasaki |
| 4,444,160 | Steele |
| 4,445,491 | Ishikawa et al. |
| 4,452,191 | Steele |
| 4,458,639 | Abe et al. |
| 4,483,284 | Andreasson |
| 4,491,100 | Yasuhara |
| 4,493,298 | Kawamura |
| U.K. Patent Application No. 2 024 940 | Kawamura et al |
| Japanese Published Patent Application No. 54-5137 | Morino |

As will be described in greater detail hereinafter, the glow plug control circuit of the present invention differs from the previously proposed circuits by providing a compact, integrated control circuit unit which can be mounted directly on a diesel engine but which is not limited to engine mounting. The circuit is able to take advantage of positive temperature coefficient (PTC) glow plug characteristics automatically to control the temperature of a variety of such glow plugs thereby providing a glow plug heating system which is insensitive to system voltage or fluctuations thereof and to ambient temperature. Heating and control thereof is achieved by utilizing a bridge circuit coupled to a comparator which, in conjunction with a low frequency oscillator clock, control the outputs of a bi-stable multivibrator which controls the energization of the glow plugs.

SUMMARY OF THE INVENTION

According to the invention there is provided an apparatus for controlling the rapid heating of one or more glow plugs which are mounted in a diesel engine, said apparatus comprising a power control circuit for controlling energization of the glow plugs; a bi-stable multivibrator for controlling energization of said power control circuit; an afterglow timer circuit coupled to said multivibrator; means for causing said bi-stable multivibrator to output a logic high signal to cause said power control circuit to energize the plugs; resistance of the one or more glow plugs and which is altered by the heating up of the glow plugs subsequent to their initial energization by said power control circuit against a reference voltage which is a fixed percentage of supply voltage and which corresponds to a predetermined set temperature of the one or more glow plugs; means for supplying a control signal to said bi-stable multivibrator when the voltage related to the temperature of the one or more glow plugs is equal to said reference voltage (1) to reset an output of said multivibrator to a logic low to de-energize said power control circuit and (2) to initiate a timing out of said afterglow timer circuit; means for supplying a clock signal to said multivibrator to cause said multivibrator to re-energize said power control circuit to re-energize the glow plugs; means for timing out said timer circuit for a predetemined time period related to the ambient temperature while control signals and clock signals are being generated intermittently to heat the glow plugs until the time period has expired; means for de-energizing said multivibrator after said time period, said voltage comparing means comprising a comparator; and means for ensuring that no false reset signals are generated by said comparator.

The apparatus also includes a timing circuit comprising a comparator, means for establishing a reference voltage and supplying same to one input of said comparator, a capacitor coupled between an input of said comparator and system ground, and means coupled to said multivibrator for controlling charging of said capacitor when the one or more glow plugs reaches a set temperature. A wait light circuit is coupled to said multivibrator and is energized by same for energizing a lamp while the apparatus is heating one or more glow plugs with a timed wait light reset circuit being provided to cause said wait light circuit to be de-energized at a predetermined time period after "power up" regardless of the generation of a reset signal.

DESCRIPTION OF THE PREFERRED EMBODIMENT

Figure 1:
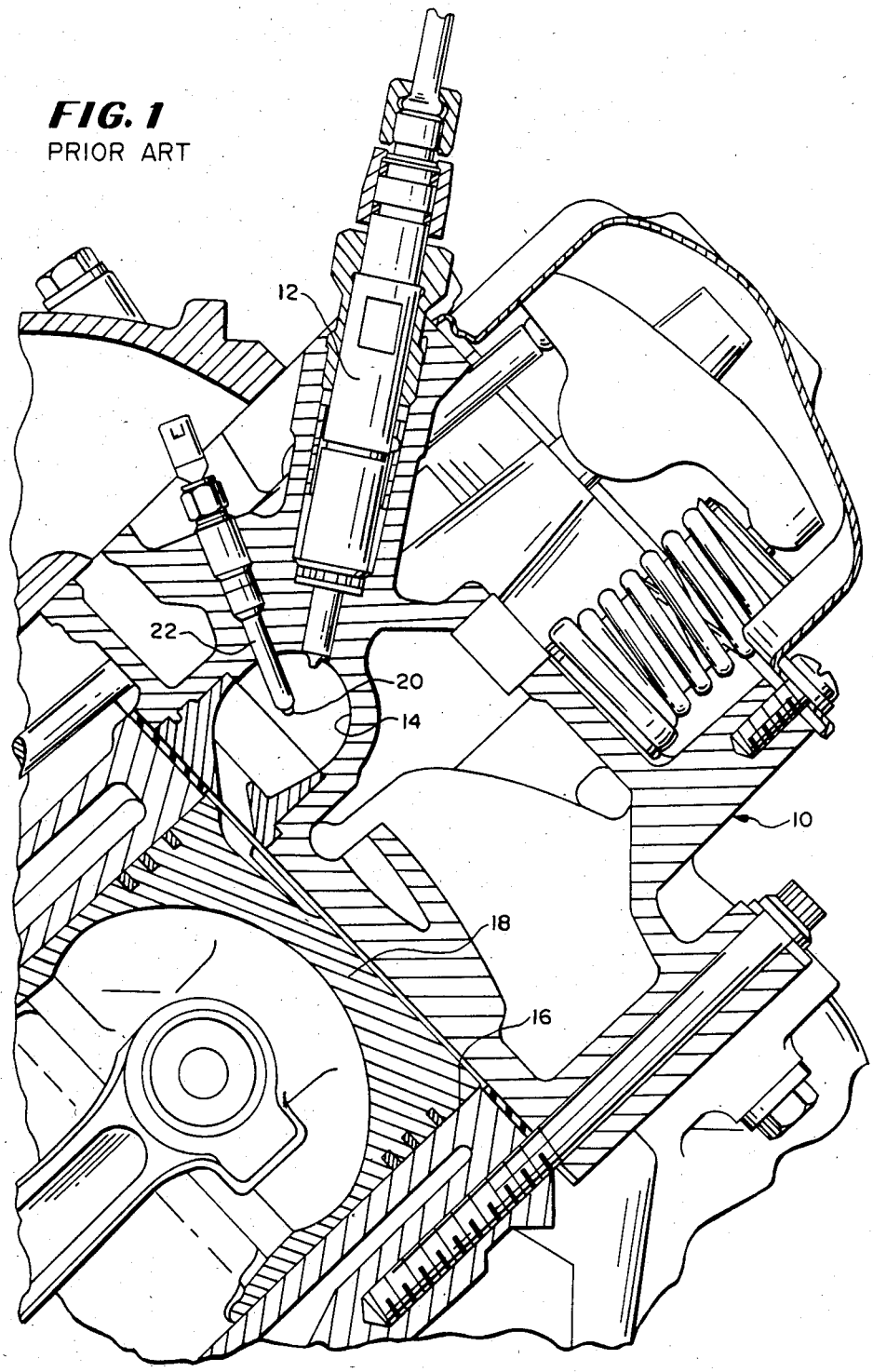
FIG. 1 PRIOR ART
FIG. 1 is a fragmentary sectional view of a prior art cylinder head of a diesel engine and shows a conventional glow plug mounted in a fuel receiving chamber just above and in communication with one cylinder of the engine.

Referring now to FIG. 1, there is illustrated therein a conventional prior art cylinder head 10 for a diesel engine having mounted therein a fuel injecting nozzle 12 for injecting fuel into a chamber 14 which is situated above and in communication with a cylinder 16 having a piston 18 therein. Also mounted in the chamber 14 is a tip 20 of a conventional glow plug 22. The diesel engine parts and their arrangement in FIG. 1 are conventional.

When the diesel engine is started, the glow plug tip 20 is heated to a predetermined temperature to cause combustion of diesel-air fuel mixtures in the cylinders.

It is desirable to heat the glow plug 22 as quickly as possible to the desired temperature without overheating the glow plugs and to maintain that temperature of the glow plugs 22 while the engine is warming up.

Figure 2:
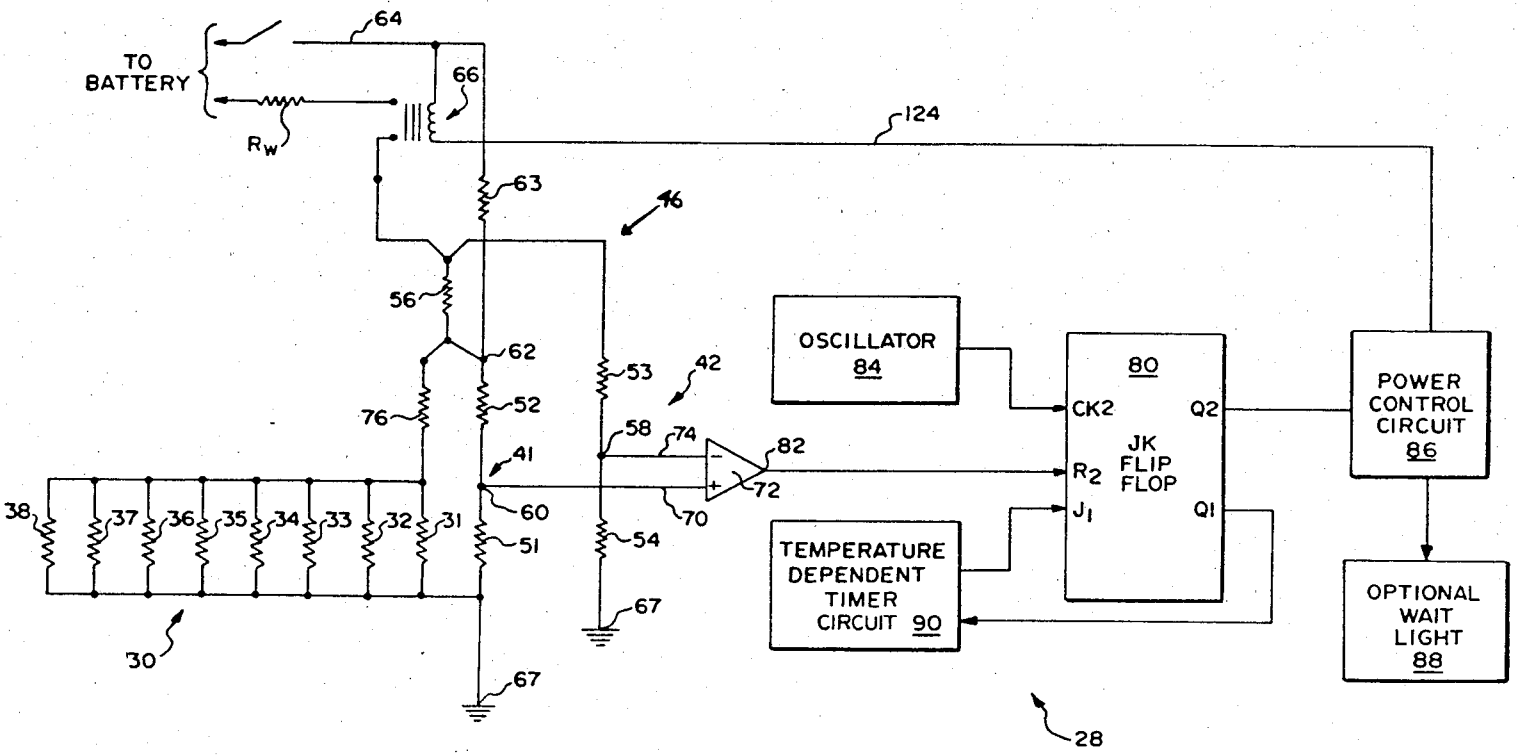
FIG. 2 is a block schematic circuit diagram of the glow plug control circuit of the present invention.

To achieve such heating of the glow plugs 22, a glow plug control circuit constructed according to the teachings of the present invention is coupled to the glow plugs 22 and is generally identified by reference numeral 28 in FIG. 2.

The block schematic circuit diagram shown in FIG. 2 of the glow plug control circuit 28 shows a bank 30 of eight glow plug resistances 31–38 connected in parallel. These eight resistances 31–38 represent Positive Temperature Coefficient (P.T.C.) glow plugs, the resistances of which will vary with temperature. Although eight resistances 31–38 are shown here, any number of glow plugs, dependent upon the number of cylinders, can be coupled to the glow plug control circuit 28. Also, the control circuit 28 is designed to control any P.T.C. glow plug but is especially useful for controlling very fast responding plugs (e.g. ceramic plugs) which can be easily damaged by crude timer based controllers.

As shown, the bank 30 of resistance 31–38 is coupled to a voltage/resistor divider 41. Another voltage/resistor divider 42 is coupled to the divider 41 for forming part of a bridge 46 and each divider 41,42 contains very precise resistance ratio resistors 51–54. A Kelvin contact resistor 56, forming part of the bridge 46, is connected between resistor 52 and the voltage source.

Voltage at a junction 58 between resistors 53 and 54 is compared with voltage at a junction 60 between resistors 51 and 52.

A junction 62 between resistors 52 and 53 is coupled by a safety resistor 63 (described in greater detail hereinafter) to a voltage bus 64 coupled to a power relay 66 for controlling the power (current) that is supplied to the bank 30 of resistances 31–38 for heating same as will be described in greater detail in connection with the description of FIG. 3. The other sides of the resistors 51 and 54 are coupled to system ground 67.

The bank 30 of glow plug resistances 31–38 is coupled across resistors 51 and 52 such that the voltage at the junction 60 is a percentage of the voltage across the glow plugs 22 and that lower voltage enables the circuit 28 to utilize a comparator which operates at a lower input voltage, e.g., around 5 volts, than the voltage, e.g., 10.5 volts, across the glow plugs 22. In this way the divider 41 effectively shifts the glow plug voltage down to the useable common mode input range of commercially available comparators.

When the equivalent resistance of the bank 30 of resistances 31–38 varies due to an increase in temperature, the voltage potential at junction 60 is varied. This junction 60 is coupled to a positive input 70 of a comparator 72. The other, negative or minus input 74 of the comparator 72 is coupled to the junction 58.

Also as described above, the safety resistor is coupled between the junction 62 and the bus 64. The resistor 63 will "pull" the voltage at the junction 60 high if the connection between the bank and junction 62 is open circuited.

Also, the resistance of the lead wire conductors is a lead harness (not shown) coupled between the glow plugs 22, and the power supply for the engine is represented by a resistance 76.

It is essential that the control circuit 28 be very insensitive to the supply voltage. This insensitivity is achieved with the connection of the circuit elements in the control circuit where:

$$Tgp = \delta + \epsilon\left[\frac{R_{56}A}{B - A} - R_W\right]$$

where:

Tgp is the temperature of the glow plugs;

$\delta$ and $\epsilon$ are characteristics of the plugs;

$R_W$ is the harness resistance between resistor $R_{56}$ and the glow plugs $$A = \frac{R_{54}}{R_{53} + R_{54}} \text{ and } B = \frac{R_{51}}{R_{51} + R_{52}}$$

Note: Tgp (the set temperature) is essentially independent of everything else such as ambient temperature and system voltage.

The glow plug control circuit 28 further includes a bi-stable multivibrator 80 which is preferably a JK flip flop. Here an output 82 from the comparator 72 is coupled to a reset input R2 of the multivibrator 80. At the same time an oscillator 84 supplies a clock signal to a clock input CK2 of the multivibrator 80.

An output Q2 from the flip flop 80 is coupled to a power control circuit 86 which in turn is coupled to the power relay 66 that controls the application of electric power to the bank 30 of the glow plug resistances 31–38.

An optional wait light circuit 88 is coupled to an output Q1 from the multivibrator 80 and is energized while the glow plug control circuit 28 is supplying power to the glow plugs 22 to heat them to the desired temperature. Once the glow plugs 22 have reached a desired set temperature, the optional wait light (not shown) of the circuit 88 is de-energized.

A temperature dependent timer circuit 90 is also coupled to the multivibrator 80. An output Q1 of the multivibrator 80 is coupled to an input to the timer circuit 90 and an output from the timer circuit 90 is coupled to an input J2 of the multivibrator 80. The timer circuit 90 is cleared and set by the signal at output Q1 from the multivibrator 80 and then supplies a logic 1 signal to the input J2 which is output from output Q2 to the power control circuit 86 on the first clock signal from the oscillator 80 to the clock input CK2.

Figure 9:
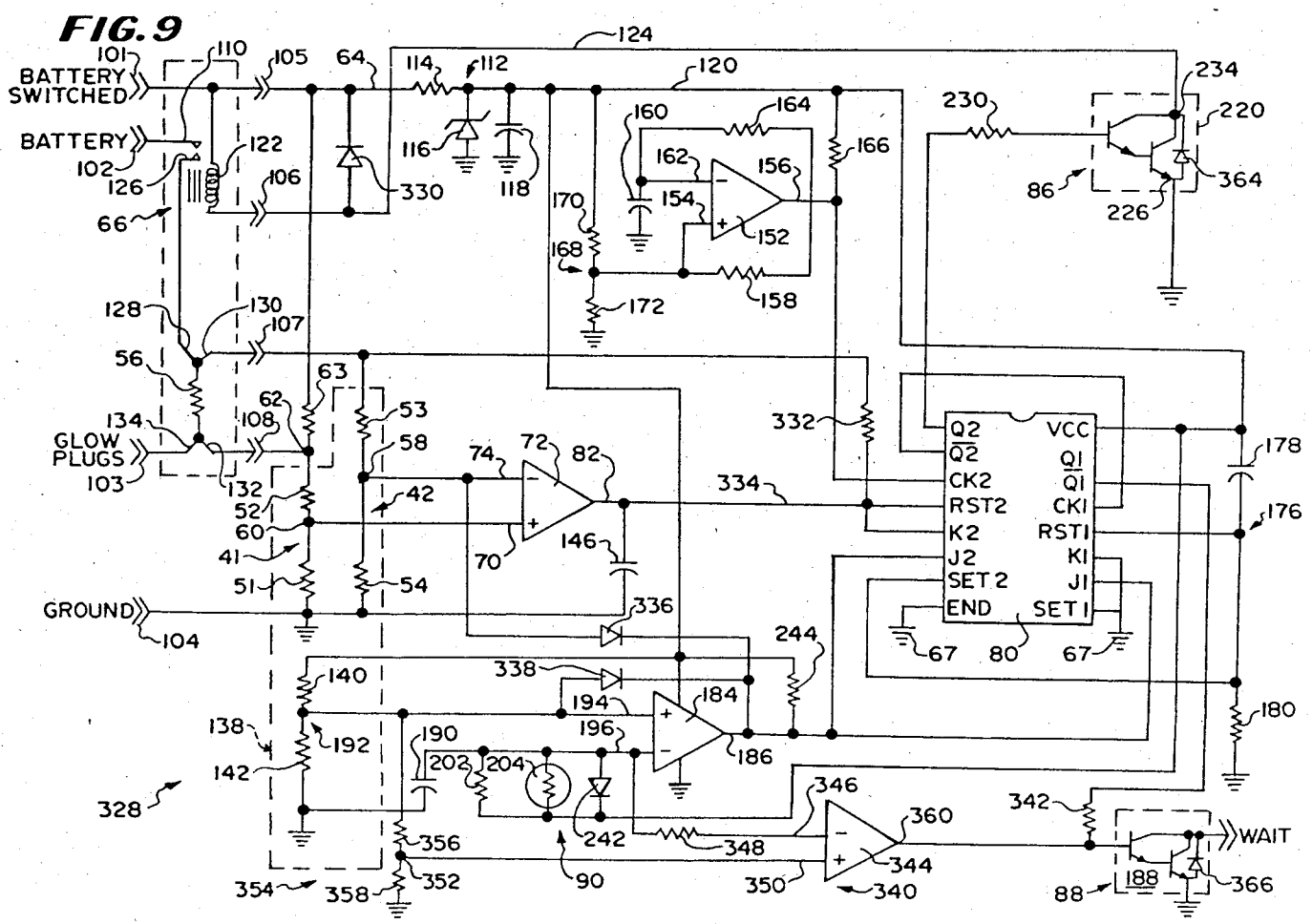
FIG. 9 is a detailed schematic circuit diagram, similar to the diagram shown in FIG. 3, of a modified glow plug control circuit.

Alternatively, with the circuit shown in FIG. 9, the timer circuit 90 can begin to time out immediately upon power up.

The signal from output Q2 to the power control circuit 86 causes the circuit 86 to energize the power relay 66 to cause relay contacts thereof to close and energize the glow plugs 22. Then, when the voltage at junction 60 supplied to the plus input 70 of the comparator 72 exceeds the reference voltage at the minus input 74 of the comparator 72, a logic 0 signal at the output 82 of comparator 72 goes high to a logic 1 and this signal is supplied to the reset input R2 of the multivibrator 80 which will cause the output at output Q2 to the power control circuit 86 to go from a logic 1 to a logic 0 thereby de-energizing the power control circuit 86 and the power relay 66 until another clock signal from the oscillator 84 is received at the clock input CK2. This will cause the logic 1 signal at the input J2 to be output at Q2 connected to the power control circuit 86 to re-energize the power relay 66 to again supply power to the bank 30 of glow plug resistances 31–38.

The frequency of the clock signals from the oscillator 84 should be high enough so that deviations about the set temperature during the afterglow period are minimized but low enough to assure durability of the power relay 66. Typically, this range is between 0.1 and 10 Hz. Empirical experiments have shown that a preferred frequency is between 0.5 and 2 Hz. The exact frequency is not important.

As will be described in greater detail hereinafter, once a reset signal is received at input R2 of the multivibrator 80, an output signal of logic 1 generated at output Q1 is supplied to the timer circuit 90 to cause the circuit 90 to "time out". The timing out of the timer circuit 90 is determined by the ambient temperature at a thermistor 204 (FIG. 3) in the circuit 90 which causes a logic 1 signal at the input J2 to go to logic 0 after a time period dependent upon the ambient temperature. This is often referred to as an "afterglow" time during which electric power is still supplied intermittently to the bank 30 of glow plugs 22 to make certain that the gaseous mixture within the prechamber is heated to a sufficient temperature from the combustion occurring in the cylinder 16 to ensure positive engine run up and to minimize white smoke output. Obviously, the colder the ambient temperature, the longer the timer circuit 90 will maintain a logic 1 signal at the input J2 of the multivibrator 80 to make certain that the engine is sufficiently heated for efficient (no white smoke) operation of the diesel engine.

Figure 3:
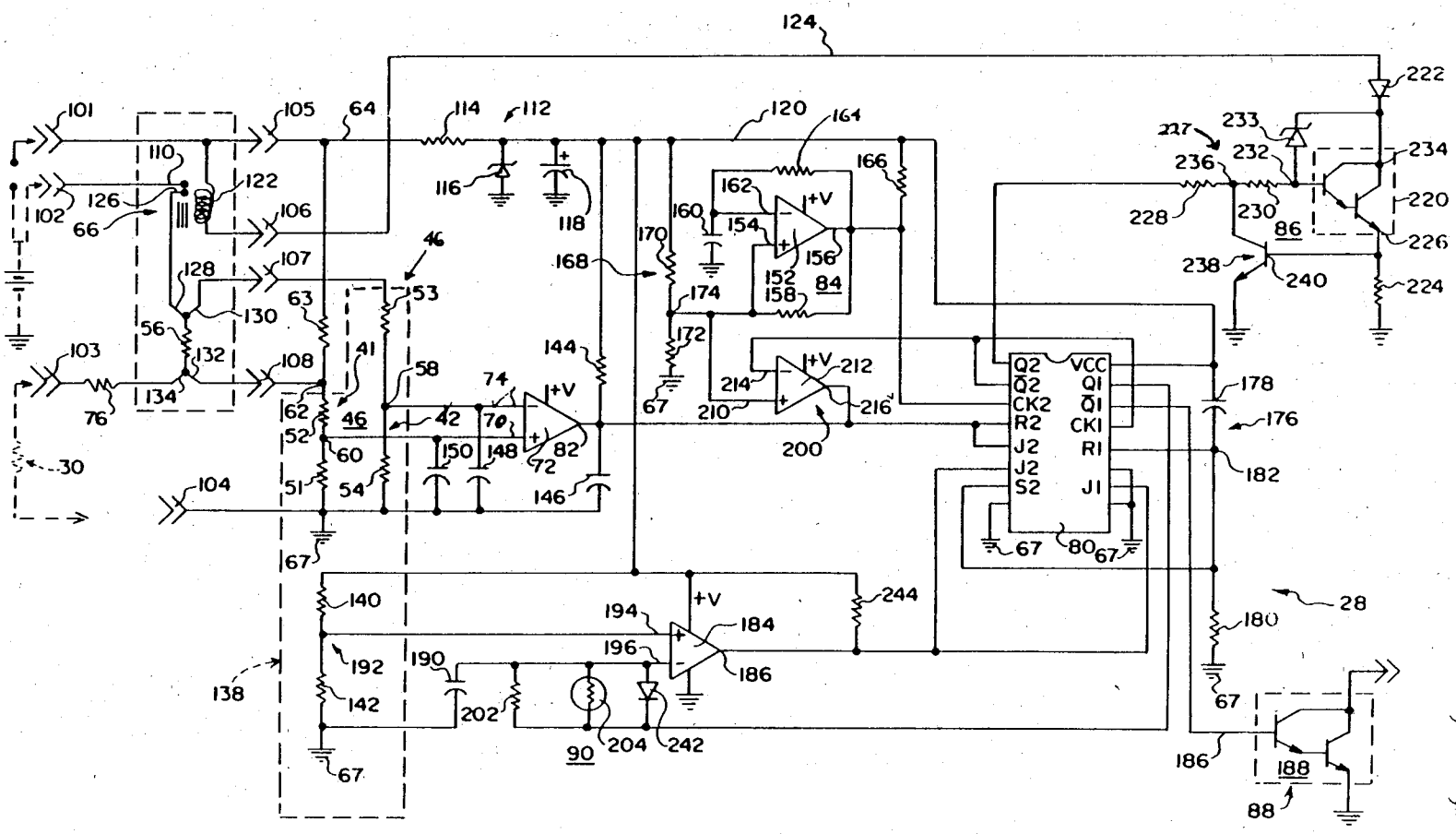
FIG. 3 is a detailed schematic circuit diagram of the glow plug control circuit shown in FIG. 2.

Referring now to FIG. 3 there is illustrated therein in greater detail, a complete schematic circuit diagram of the glow plug control circuit 28 of the present invention. First of all, a number of connect/disconnect connections 101–108 are shown. One connection 101 is a connection to the switched on battery. Another connection 102 is direct to the battery and supplies current to a relay contact 110 of the power relay 66. Another connection 103 is to the glow plugs 22 and the bank 30 of glow plug resistances 31–38. The connection 104 is to system ground 67. Here, lead conductor resistance 76 is shown coupled between connection 103 and a terminal 134.

The connections 101–108 can be plug and socket type connections or lug and bolt connections.

The switched on battery connection is also coupled through a connect/disconnect connection 105 to a voltage regulating and filter circuit 112 comprising a resistor 114, a Zener diode 116 and a capacitor 118 connected as shown. During normal operation, the input through connection 105 can be anywhere between 6 and 18 volts, and even up to 24 volts, and the regulated output voltage will be between 6 and 12 volts from the circuit 112 on a regulated bus 120.

Coil 122 of lower relay 66 is connected from the unregulated bus 64 through connection 106 and a conductor 124 to the power control circuit 86.

Another relay contact 126 of the power relay 66 is connected to a contact 128 of resistor 56 and a sensing lead 130 of the resistor 56 is coupled through connection 107 to resistor 53.

Another connection 108 is between a sensing lead 132 of resistor 56 and the junction 62. The lead wire resistance 76 which is typically 1.17 milliohms is shown coupled between the glow plug resistances 31–38 and contact 134 of resistor 56.

Figure 5:
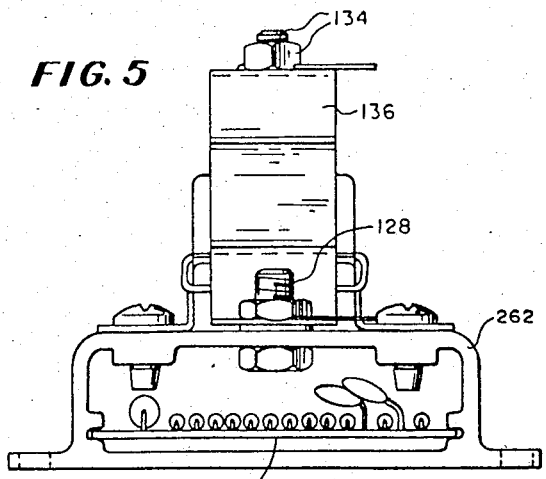
FIG. 5 is an end elevational view of the chassis shown in FIG. 4, is taken along line 5—5 of FIG. 4, and shows the printed circuit board with components mounted thereon in the chassis.
Figure 4:
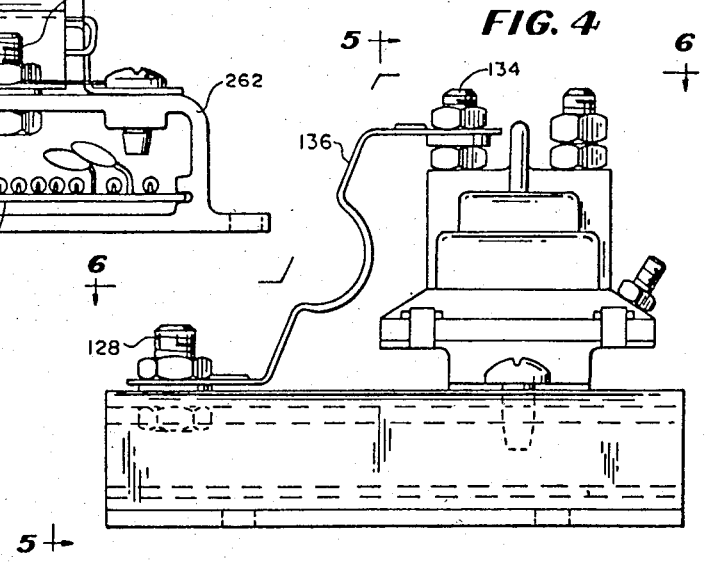
FIG. 4 is a side elevational view of the chassis for the printed circuit board of the glow plug control circuit and shows exterior components of the circuit.
Figure 6:
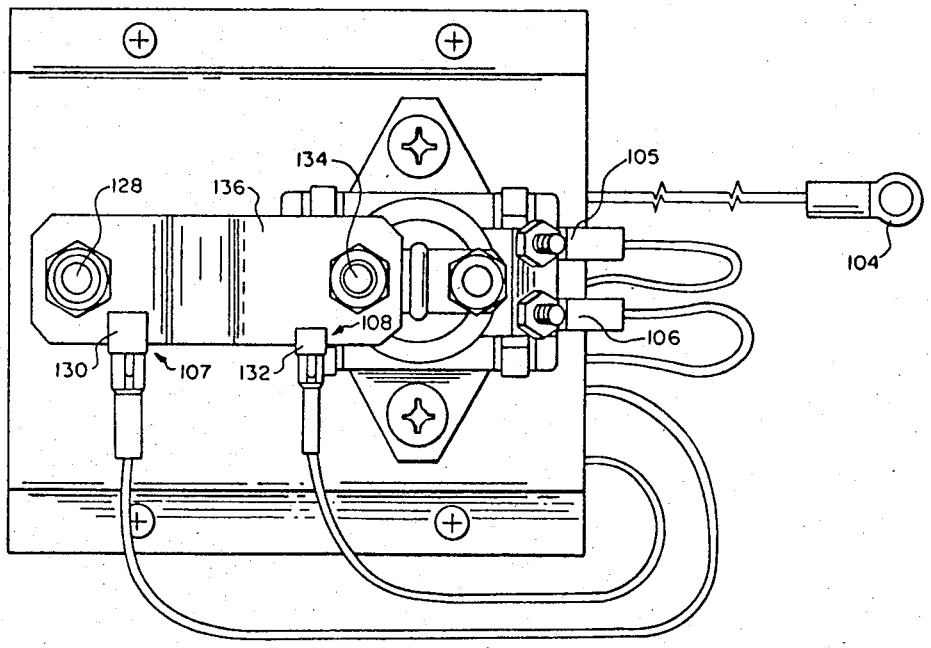
FIG. 6 is a top plan view of the chassis shown in FIG. 4, is taken along line 6—6 of FIG. 4 and shows lead connections from the printed circuit board to terminals on the chassis and to a low resistance bus bar for adjusting a low resistance value in the glow plug control circuit.

Resistor 56 is a four contact nickel-chrome alloy resistor which has a very low resistance of approximately 0.005 ohm and which is realized by a bus bar 136 (FIGS. 4, 5 and 6). Kelvin contacts 130 and 132 are welded in place such that the 0.005 ohms resistance appears between the contacts.

In practice, it may be desirable to adjust the upper contact, 130, prior to welding to effect an active trim of the control circuit 28. This would be done at the time of the module assembly. This is preferred since field adjustment is not recommended.

The resistor 56 is referred to as a four terminal Kelvin contact device. Such a resistor can be made very accurately to 0.005 ohm by adjustment of the two sensing leads 130 and 132. These leads measure a voltage drop across the metal bus or strip of metal 136. Typically, what takes place is that a reference current (e.g. 10 amps) is caused to flow through the metal strip 136 via power terminals 128 and 134 and the two sensing leads 130 and 132 are coupled to the strip at different points as shown in FIG. 6, and adjusted to a point where the voltage corresponding to the desired resistance is obtained. (E. g., for 0.005 ohm at 10 amps, 50 MV will be read).

Typically, the resistance value of resistors 51, 52 and 54 is 3.3 K ohms and of resistor 53 is 3.685 K ohms.

The resistance ratios are critical, and to achieve accurate ratios very accurate resistors are used and are shown within a phantom box 138. These resistors include not only the resistors 51–54, but also resistors 140 and 142 in the timer circuit 90 which will be described in greater detail hereinafter. Best results are obtained when the resistor accuracy for resistors 51–54, 140 and 142 is between 0.1 and 0.125%. The best method for controlling these ratios is to make use of thick or thin film networks.

It will be apparent from the portion of the glow plug control circuit 28 described so far, that if connection 108 were open circuited while the other connections were still intact, the glow plugs 22 would be overheated. To prevent this from happening, the safety resistor 63 brings up the voltage at the positive input 70 of the comparator 72 so that it appears to the comparator 72 that the resistances 31–38 of the glow plugs 22 have increased sufficiently to cause the comparator 72 to de-energize the power relay 66 so that the glow plugs 22 are not overheated. A typical value for resistor 63 is 180 ohms. This is much larger than the resistance of the parallel connected sense resistor 56 (approximately 0.005 ohm) so as to have a negligible effect on the control circuit 28 accuracy.

As shown, the voltages at junctions 60 and 58 are supplied to the positive and negative inputs 70,74 of comparator 72 which then has its output 82 coupled to the reset input R2 of the multivibrator 80.

Also as shown, a voltage pull up resistor 144 is connected between the regulated voltage bus 120 and the output 82 of the comparator 72 and a capacitor 146 is connected between the output 82 of the comparator 72 and system ground 67. Resistor 144 is required because the comparator 146 has an open collector output. The combination of resistor 144 and capacitor 146 form a low pass filter. The principle purpose of the low pass filter is to keep the comparator 146 from responding to extraneous noise generated by the mechanical relay contacts but will also prevent response to externally induced noise.

Capacitors 148 and 150 are coupled respectively to comparator inputs 70 and 74 for filtering out radio frequency noise.

The comparator output 82 is coupled to the reset input R2 of multivibrator 80 which also receives clock pulses generated by the oscillator 84 at the clock input CK2.

The oscillator 84 includes a comparator 152 having between its plus input 154 and output 156 a hysteresis resistor 158 which pulls the voltage input to the plus input 154 up or down dependent upon the charging of a capacitor 160 which is connected between ground 67 and minus input 162 of the comparator 152. This capacitor 160 is charged and discharged through a feedback resistor 164 connected between the output 156 and the input 162 of the comparator 152. Voltage is supplied through a coupling resistor 166 from the bus 120 to the output 156.

Also, a voltage divider 168 comprising resistors 170 and 172 is coupled between the bus 120 and ground 67 and a midpoint 174 thereof is coupled to the comparator input 154 to provide an initial bias voltage which is pulled up or down by the hysteresis resistor 158.

It is convenient to choose resistor 158=resistor 170=resistor 172. Then $f=0.721/RC_{160}$.

When a clock signal from the oscillator 84 is supplied to the clock input CK2 and the value of the signal to the reset input R2 is logic 0, the logic value at input J2 is clocked through multivibrator 80 to the output Q2.

To establish desirable initial conditions, an initializing circuit 176 comprising capacitor 178 and a resistor 180 are coupled between the bus 120 and ground 67 and the junction 182 therebetween is coupled to reset input R1 and set input S2 of the multivibrator 80.

It will be noted that the timer circuit 90 includes a comparator 184 which has its output 186 coupled to the inputs J2 and J1 of the multivibrator 80.

Briefly, the operation of the glow plug control circuit 28 and more particularly the multivibrator 80 is as follows.

When the power is turned on, the capacitor 178 initially acts as a short circuit and supplies a logic 1 input to the reset input R1. This reset forces Q1 to logic 0 and $\overline{Q1}$ to logic 1. The logic 1 at $\overline{Q1}$ is supplied to the base 186 of a Darlington transistor pair 188 of the wait light circuit 88 for energizing the optional wait light circuit 88. When the wait light (not shown) goes on, this tells the operator of the vehicle that the glow plug control circuit 28 is energized and that the operator should wait until the light goes off before starting the engine As will be described in connection with the description of FIG. 9, an additional circuit can be used to shorten the wait time under conditions of warm ambient temperatures.

The initial logic 0 output from the output Q1 is supplied to a capacitor 190 in the timer circuit 90 via resistor 202 thereby to discharge any charge on the capacitor 190. In the meantime, a voltage from a voltage divider 192 comprising the resistors 140 and 142 connected between bus 120 and ground 67 is applied to input 194 of the comparator 184 in the timer circuit 90. The reference voltage at the plus input is above the zero voltage at the negative input of the comparator input 196 so that initially there is a logic 1 output from the comparator 184 which is supplied to the inputs J2 and J1 of the multivibrator 80. The initializing circuit 176 also supplies a set signal to the input S2 which forces Q2 to a logic 1 thereby energizing the power control circuit 86 to energize the glow plugs 22. As a result, the clock pulses being generated do not have an effect on the output Q2 until the voltage at input 70 goes above the voltage at input 74 at which time the output supplied to the reset input R2 goes from logic 0 to logic 1 and also to the clock input CK1 which then clocks the logic 1 at input J1 to output Q1. This supplies a voltage through a resistor 202 and an NTC thermistor 204 to the capacitor 190 in the timer circuit 90 which then starts to charge. This starts the so-called "afterglow" time period and this occurs once the glow plugs 22 have reached their initial set temperature. Also the output $\overline{Q2}$ is forced low to de-energize the relay 66 and the glow plugs 22 are now de-energized and begin to cool.

When the power relay contacts opens both inputs to comparator 72 are essentially at ground potential. Thus output 82 is undefined. Circuit 200 overrides output 82 under these conditions ($\overline{Q2}$ high indicates relay is off) and ensures that reset R2 is held low so that oscillator 84 will be able to reactivate output Q2.

Another circuit for forcing the output 82 to a well defined state is described below in connection with the description of FIG. 9.

The oscillator is set at a sufficiently high frequency so that the plugs 22 will be re-energized before a large amount of cooling occurs (e.g. 10° to 20° F.).

When the logic at reset input R2 returns back to logic 0, the logic 1 at the input J2 is clocked to the output Q2 at the next clock pulse for re-energizing the control circuit 86, and thereby the relay 66, to cause reheating of the glow plugs 22.

In the meantime, however, the capacitor 190 is charging so that the intermittent on-off heating of the glow plugs 22 will last for a time (e.g. up to 90 seconds) sufficient to maintain the glow plugs 22 heated sufficiently for efficient operation of the diesel engine.

In other words, the glow plugs 22 will continue to be energized for a time period determined by the timer circuit 90 which is a time period sufficient to eliminate white smoke from the engine exhaust.

A plus voltage is supplied to a plus input 210 of a comparator 212 from the midpoint 174 of the voltage divider 168. At the same time, the logic at the output $\overline{Q2}$, which is initially a logic 0, is supplied to a negative input 214. Accordingly, the plus input 210 is greater than the negative input 214 whereby a logic 1 is at output 216 of comparator 212 and is pulled low by the logic 0 output of the comparator 72. Then, when the reset input R2 goes from logic 0 to 1 to change the output $\overline{Q2}$ from logic 1 to logic 0, the output $\overline{Q2}$ goes from logic 0 to logic 1. This logic 1 output from output $\overline{Q2}$ is supplied, as described above, to the clock input CKI to cause the logic 0 at output Q1 to go to logic 1 to start the timing circuit 90. At this time, this logic 1 goes to the negative input 214 which is higher than the voltage at input 210 driving output 210 to zero. This logic 0 then forces the reset input R2 back to zero so that the multivibrator 80 is ready for the next clock pulse or signal from the oscillator 84. Again, for proper operation of the circuit 28, the frequency of the clock pulses must be relatively low, i.e., between 0.1 and 10 Hz and typically between 0.5 and 2 Hz.

When the ambient temperature is very cold, such as 0° F. or lower, it will take a longer time for the capacitor 190 to charge up to a voltage equivalent to or higher than the voltage at input 194. This means that the glow plugs 22 will be energized intermittently by the oscillator circuit for an "afterglow" time period dependent upon ambient temperature after the set temperature has been reached. This timing period may reach 90 seconds when it is very cold.

On the other hand, when the temperature is very high, e.g. 100° F., the resistance of the thermistor 204 is very low and the capacitor 190 will charge very quickly so that the afterglow time is essentially zero time.

The timing circuit 90 also includes a voltage pull up resistor 244 coupled between the comparator output 186 and the voltage bus 120. The bus voltage is also supplied to the power supply input pin of the comparator 184 and to similar pins on all the other comparators 72, 152 and 212.

Further, the timing circuit 90 includes a diode 242 connected as shown for effecting a quick discharge of capacitor 190 when output Q1 is at logic 0. This provides a control circuit 28 reset so that a new control cycle can be initiated if the engine fails to start during the first cycle.

Referring now to FIGS. 4, 5 and 6, the control circuit 28 is mounted on a printed circuit board 260 received in a chassis or housing 262. This housing 262 is mounted at a convenient location on the vehicle and the bus bar or metal strip 136 is mounted on the housing 262.

In FIG. 6 the connections 104, 105 and 106 are shown as lug connectors to a pin, terminal or bolt and the connections 107 and 108 are shown as slidable clip connections of sensing leads 130 and 132 to bus bar 136.

Figure 7:
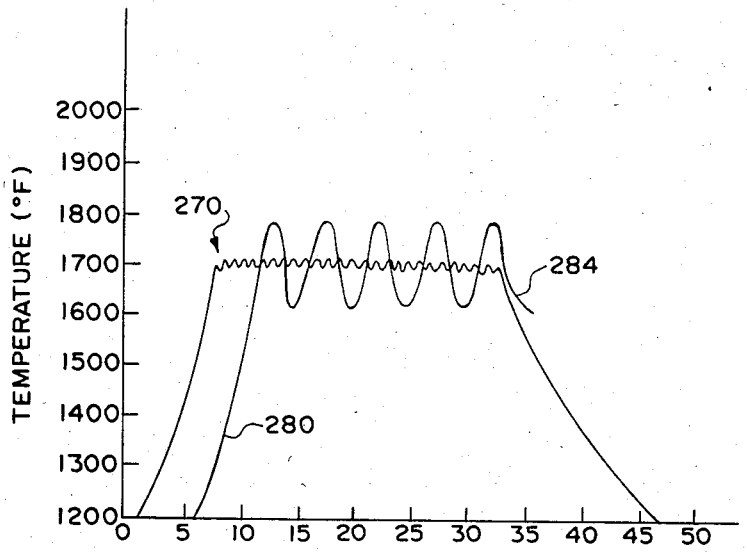
FIG. 7 is a graph of temperature versus time for the hot spot of a glow plug energized by a prior art circuit and of a glow plug energized by the glow plug control circuit of the present invention.

FIG. 7 shows a graph 270 of temperature versus time of a so-called "hot spot" on a glow plug tip 20. Zener diode 233 enables transistor 220 to suppress the inductive voltage kick which occurs when the relay coil 122 is deactivated. Otherwise, collector-emitter punch through could occur should the $V_{ceo}$ rating of transistor 220 be exceeded.

Referring now to the power control circuit 86, this circuit 86 includes Darlington transistor pair 220 having a high gain which is coupled to the one side of a relay coil 122 through a protecting diode 222 (which prevents any damage to the circuit 86 if the battery is connected with reverse polarity) and the conductor 124 and the connector 106. A current sensing resistor 224 is coupled between emitter 226 and ground 67.

The output Q2 is connected through a voltage divider circuit 227 made up of resistors 228 and 230 to a base 232 of the Darlington transistor pair 220. A Zener diode 233 is connected between a collector 234 and the base 232 as shown. Also, a junction 236 between the resistors 228 and 230 is coupled through a transistor 238 to ground 67 to provide current limiting at the power control circuit 86 if there is too much current flowing through resistor 224 which is coupled to base 240 of the transistor 238. In this respect, the voltage generated by a high current flowing through resistor 224 will turn on transistor 238 causing same to conduct and pull down the voltage at the base 232 of transistor pair 238 to turn the pair 220 off. Q238 can only turn on to such a point that the voltage across resistor 224 is limited to $V_{be}$.

Returning now to the timer control circuit 90, as previously stated, the timer circuit 90 is initialized by initializing circuit 176 to discharge any charge on the capacitor 190 and to maintain a logic 1 at comparator output 186 to the inputs J2 and J1 of the multivibrator 80. Then, when a logic 1 timing signal is generated at the output Q1, the capacitor 190 starts to charge. This charging is controlled by the parallel connection of resistor 202 and NTC thermistor 204. The NTC thermistor 204 has an inverse temperature resistance characteristic such that the colder the temperature, the higher the resistance.

Initially, the capacitor 190 is pulled low through diode 242 whioh is conn®cted to output Q1 which has a low output. Then when a reset signal comes into reset R2, such signal forces the output of $\overline{Q2}$ to go high and that signal goes into clock input CK1 and forces the output of Q1 to go high. With the output of Q1 high, the capacitor 190 starts to charge and charges until its voltage supplied to comparator input 196 exceeds the voltage at the input 194 which forces the voltage or signal level at the output 186 to go from a high to a low. This low is fed to input J2 and J1 and with the input at J2 low the flip flop 80 cannot clock through any more signals. At this time the engine should be running properly without producing white smoke.

As shown the timer circuit 90 also includes the voltage pull up resistor 244 connected between V+ and the output 186 of the comparator 184.

In FIG. 7 is shown a graph 270 of temperature versus time for glow plugs energized by the control circuit 28 of the present invention. Also shown is a graph 280 of temperature versus time of a "hot spot" on a glow plug tip 20 energized by a bimetal type control circuit such as the circuit developed by Allied Chemical Corporation. Heating time depends on the glow plug characteristic. The operating temperature may be chosen freely with either the Allied Chemical corporation circuit or the control circuit 28 of the present invention.

Figure 8:
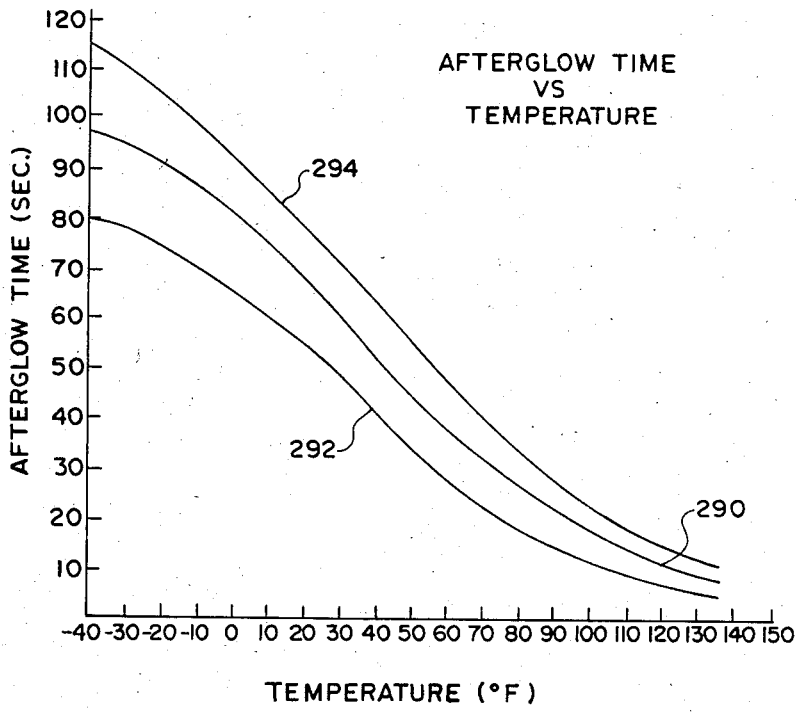
FIG. 8 is a graph of after glow time versus ambient temperature provided by the glow plug control circuit of the present invention where a capacitor in the circuit has a tolerance of ±20%.

In FIG. 8 is shown a graph 290 of the afterglow time versus ambient temperature. Also there is shown, upper and lower shifts 292 and 294 of this curve for a capacitor 190 having a ±20% accuracy.

In FIG. 9 is illustrated a schematic circuit diagram of a modified glow plug control circuit 328 wherein circuit elements that are identical to circuit elements in the control circuit 28 are identified with the same reference numerals. The modified circuit 328 includes a diode 330 connected across the coil 22 for suppressing the inductive transient which is generated when transistor 220 turns off.

A more important modification is the replacement of the reset input stabilizing circuit 200 with an RC circuit comprising a resistor 332 and capacitor 146 series connected between positive Kelvin contact 130 and ground 67 with a junction 334 connected to output 82 of comparator 72.

When power is applied to the coil 122 of power relay 66 there is an unspecified delay of approximately 12 milliseconds before the relay contacts 110 and 126 close. During this time, the inputs 70, 74 to comparator 72 are essentially at ground potential and the output 82 of the comparator 72 is undefined and could switch high or low and a false reset pulse could be generated.

The RC circuit made up of resistor 332 and capacitor 146 suppresses any false reset pulse which would be generated if comparator 72 switches high.

With the pull up resistor 332 connected to the positive Kelvin contact 130 so that until the relay 66 actually pulls in and closes contacts 110 and 126, the output 82 of the comparator 72 is held low so that any delay in activation of the relay 66 will not result in any false reset pulses.

Another modification is the provision of a forward biased diode 336 coupled between junction 58 (input 74 to comparator 72) and the output 186 of comparator 184 and a forward biased diode 338 coupled between the input 194 and output 186. These diodes 336 and 338 generate a forcible reset at the output of comparator 82 at the end Of the afterglow time. This allows the system to deactivate at the end of the afterglow period in the event that the plugs are so cold or the system voltage is so low that normal resets are not being generated.

More specifically, to avoid unwanted resets due to noise from being injected into the circuit 328, the diode 338 provides hysteresis for the afterglow timing control circuit 90 and a timed wait light reset circuit 340 described below. The diode 338 ensures that once the wait time expires, a reset cannot be generated unless the supply voltage falls to within one volt of ground.

A further modification is the provision of the timed wait light reset circuit 340 which makes certain that the wait light circuit 88 is turned off either on a reset pulse through a resistor 342 from the $\overline{Q1}$ output of flip flop 80 when flip flop 80 is reset or after the timed wait reset circuit (coupled to timer control circuit 90) has timed out.

The reset circuit 340 includes a comparator 344 having a minus input 346 which is coupled through a resistor 348 with input 196. The comparator 344 also has a positive input 350 coupled to a junction 352 of a voltage divider 354 comprised of resistors 356 and 358 coupled between input 194 and ground 67. The timed wait light reset circuit 340 makes use of the timing capacitor 190 in the timer control circuit 90. As shown an output 360 of comparator 344 is coupled to the wait light circuit 88.

It is possible at low temperature, e.g. −20° F., that the wait light is not operated by the flip flop 80. However on power up, capacitor 190 begins to time out both the timer control circuit 90 and the timed wait light reset circuit 340 so that after a predetermined time, the wait light is turned off regardless of whether or not flip flop 80 is reset.

Two other minor modifications are the provisions of protection diode 366 in wait light circuit 88 and protection diode 364 in the power control circuit 86.

From the foregoing description, it will be apparent that the glow plug control circuit of the present invention has a number of advantages some of which have been described above and others of which are inherent in the invention.

Two advantages are:

1. That the plug temperature will be held accurately during operation. (The Allied Chemical Corporation system cannot compensate for external heating and cooling of the plugs which occurs due to varying conditions in the pre-chamber); and 2. That wide excursions in temperature are eliminated during the control cycle.

More specifically, the control circuit 28, or simply controller 28, provides:

1. Circuitry for pulse width modulation (PWM) of a string of glow plugs wherein the modulation frequency may be chosen arbitrarily without effecting the operating set temperature of the glow plugs. This allows for an optimal choice of frequency, fast enough so that the plug sheath temperature is effectively constant but slow enough so that the power relay life does not suffer.

2. Construction of a bridge circuit in which a relatively high level voltage at the glow plug leg of the bridge may be conveniently shifted downward thus allowing the use of commonly available integrated circuit voltage comparators which have a limited common mode input range. This results in a controller which will operate accurately over a very wide range of supply voltages. (With proper choice of component values the system will work with both 12 and 24 volt systems interchangeably).

3. Simple circuitry including a JK flip flop for initiating time out of an afterglow timer at the point in time where the glow plugs reach the predetermined operating temperature and, if desired, for activating a wait lamp for the period of time between application of power to the controller and the time of reaching the plug operating temperature. The controller automatically compensates for variations between different types of plugs and for varying initial conditions. For example, if very rapidly heating (low thermal inertia) ceramic plugs are used, the wait period is automatically shortened to just that period needed to reach the set operating temperature.

4. The RC circuit (resistor 332 and capacitor 146) ensures stable operation of comparator 72 and prevents the generation of false reset signals.

5. The timed wait light reset circuit 340 ensures turning off of the wait light independent of a reset signal.

Accordingly, the scope of the present invention is only to be limited as necessitated by the accompanying claims.

We claim:

1. An apparatus for controlling the rapid heating of one or more glow plugs which are mounted in a diesel engine, said apparatus comprising a power control circuit for controlling energization of the glow plugs; a bi-stable multivibrator for controlling energization of said power control circuit; an afterglow timer circuit coupled to said multivibrator; means for causing said bi-stable multivibrator to output a logic high signal to cause said power control circuit to energize the plugs; means for comparing a voltage which is related to the resistance of the one or more glow plugs and which is altered by the heating up of the glow plugs subsequent to their initial energization by said power control circuit against a reference voltage which is a fixed percentage of supply voltage and which corresponds to a predetermined set temperature of the one or more glow plugs; means for supplying a control signal to said bi-stable multivibrator when the voltage related to the temperature of the one or more glow plugs is equal to said reference voltage (1) to reset an output of said multivibrator to a logic low to de-energize said power control circuit and (2) to initiate a timing out of said afterglow timer circuit; means for supplying a clock signal to said multivibrator to cause said multivibrator to re-energize said power control circuit to re-energize the glow plugs; means for timing out said timer circuit for a predetermined time period related to the ambient temperature while control signals and clock signals are being generated intermittently to heat the glow plugs until the time period has expired; means for de-energizing said multivibrator after said time period, said voltage comparing means comprising a comparator; and means for ensuring that no false reset signals are generated by said comparator.

2. The apparatus of claim 1 wherein said means for ensuring against false reset signals comprise a resistor connected between a terminal coupled to a power relay and the output of said comparator and a capacitor connected between the output of said comparator and ground.

3. An apparatus for controlling the rapid heating of one or more glow plugs which are mounted in a diesel engine, said apparatus comprising a power control circuit for controlling energization of the glow plugs; a bi-stable multivibrator for controlling energization of said power control circuit; an afterglow timer circuit coupled to said multivibrator; means for causing said bi-stable multivibrator to output a logic high signal to cause said power control circuit to energize the plugs; means for comparing a voltage which is related to the resistance of the one or more glow plugs and which is altered by the heating up of the glow plugs subsequent to their initial energization by said power control circuit against a reference voltage which is a fixed percentage of supply voltage and which corresponds to a predetermined set temperature of the one or more glow plugs; means for supplying a control signal to said bi-stable multivibrator when the voltage related to the temperature of the one or more glow plugs is equal to said reference voltage (1) to reset an output of said multivibrator to a logic low to de-energize said power control circuit and (2) to initiate a timing out of said afterglow timer circuit; means for supplying a clock signal to said multivibrator to cause said multivibrator to re-energize said power control circuit to re-energize the glow plugs; means for timing out said timer circuit for a predetermined time period related to the ambient temperature while control signals and clock signals are being generated intermittently to heat the glow plugs until the time period has expired; means for de-energizing said multivibrator after said time period, said timer circuit being coupled to a positive voltage bus and said apparatus being initialized by voltage applied to said bus.

4. The apparatus of claim 3 wherein said timer circuit comprises a comparator, means for establishing a reference voltage and supplying same to one input of said comparator, a capacitor coupled between an input of said comparator and system ground, and means coupled to said multivibrator for controlling charging of said capacitor when the one or more glow plugs reaches a set temperature.

5. The apparatus of claim 4 wherein said controlling means comprise a logic output from said multivibrator which is clocked from a "low" to a "high" to start charging of said capacitor when the one or more glow plugs reaches a set temperature.

6. The apparatus of claim 4 wherein said controlling means include a thermistor having a resistance value inversely related to the ambient temperature and being series coupled with said capacitor to control the timing out time period.

7. The apparatus of claim 4 including a wait light circuit coupled to said multivibrator and energized by same for energizing a lamp while the apparatus is heating the one or more glow plugs.

8. The apparatus of claim 7 including a timed wait light reset circuit coupled to said capacitor of said timer circuit and to said wait light circuit for causing said wait light circuit to be de-energized at a predetermined time period after "power up" regardless of the generation of a reset signal.

* * * * *